US009917398B1

(12) United States Patent
Ryland et al.

(10) Patent No.: US 9,917,398 B1
(45) Date of Patent: Mar. 13, 2018

(54) MECHANICAL SNAP CONNECTOR ASSEMBLY

(71) Applicant: Barobo, Inc., West Sacremento, CA (US)

(72) Inventors: Graham G. Ryland, West Sacramento, CA (US); David Ko, Woodland, CA (US)

(73) Assignee: BAROBO, INC., West Sacramento, CA (US)

( * ) Notice: Subject to any disclaimer, the term of this patent is extended or adjusted under 35 U.S.C. 154(b) by 713 days.

(21) Appl. No.: 14/222,463

(22) Filed: Mar. 21, 2014

Related U.S. Application Data

(60) Provisional application No. 61/803,791, filed on Mar. 21, 2013.

(51) Int. Cl.

| | |
|---|---|
| ***H01R 13/62*** | (2006.01) |
| ***H01R 43/26*** | (2006.01) |
| ***A63H 33/06*** | (2006.01) |
| ***H01R 13/627*** | (2006.01) |

(52) U.S. Cl.
CPC ..... *H01R 13/627* (2013.01); *A63H 33/062* (2013.01); *H01R 43/26* (2013.01)

(58) Field of Classification Search
CPC ..... A63H 33/062; H01R 13/627; H01R 13/6272; H01R 13/6273; H01R 43/26
USPC ..... 446/108, 116, 120, 121, 127
See application file for complete search history.

(56) References Cited

U.S. PATENT DOCUMENTS

| | | | | |
|---|---|---|---|---|
| 4,272,145 | A * | 6/1981 | LaDuke | H01R 13/6272 439/358 |
| 4,836,408 | A * | 6/1989 | Roy | E05C 19/06 220/4.02 |
| 5,106,093 | A * | 4/1992 | Engel | A63H 33/08 273/160 |
| 5,993,283 | A * | 11/1999 | Cyrus | A63H 33/04 446/108 |
| 6,113,415 | A * | 9/2000 | Bertsch | H01R 13/6273 439/353 |
| 6,379,077 | B1 * | 4/2002 | Camber | E21D 11/083 24/618 |
| 7,572,139 | B2 * | 8/2009 | Montena | H01R 23/10 439/358 |
| 8,926,355 | B2 * | 1/2015 | Heil | H01R 13/641 439/352 |
| 2003/0027456 | A1 * | 2/2003 | Yamawaki | H01R 13/6273 439/595 |
| 2006/0286839 | A1 * | 12/2006 | Bethurum | H01R 4/4818 439/188 |
| 2007/0054588 | A1 * | 3/2007 | Gastaldi | A63H 33/06 446/108 |

(Continued)

*Primary Examiner* — Ryan D Kwiecinski
(74) *Attorney, Agent, or Firm* — Morrison & Foerster, LLP

(57) ABSTRACT

A connector assembly includes a first component having a slot and an indentation and a second component having a hook and a protrusion. The hook is configured to engage with the slot by being inserted into the slot and being translated with respect to the slot. The protrusion is configured to at least partially depress as the hook is inserted into the slot and engage with the indentation when the hook is positioned to engage with the slot. The hook and the slot, when engaged, resist separation of the second component from the first component. The protrusion and the indentation, when engaged, resist disengagement of the hook from the slot.

34 Claims, 19 Drawing Sheets

(56) References Cited

U.S. PATENT DOCUMENTS

| | | | | |
|---|---|---|---|---|
| 2009/0140112 | A1* | 6/2009 | Carnevali | F16B 5/0657<br>248/223.41 |
| 2010/0093204 | A1* | 4/2010 | Morello | H01R 13/6272<br>439/346 |
| 2012/0282791 | A1* | 11/2012 | Brown | H01R 13/639<br>439/157 |
| 2016/0005331 | A1* | 1/2016 | Ryland | B25J 9/08<br>434/118 |

* cited by examiner

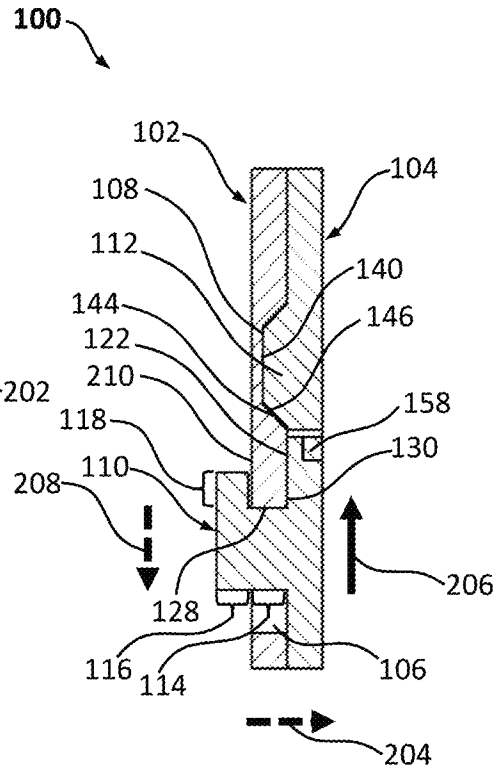
FIG. 2A
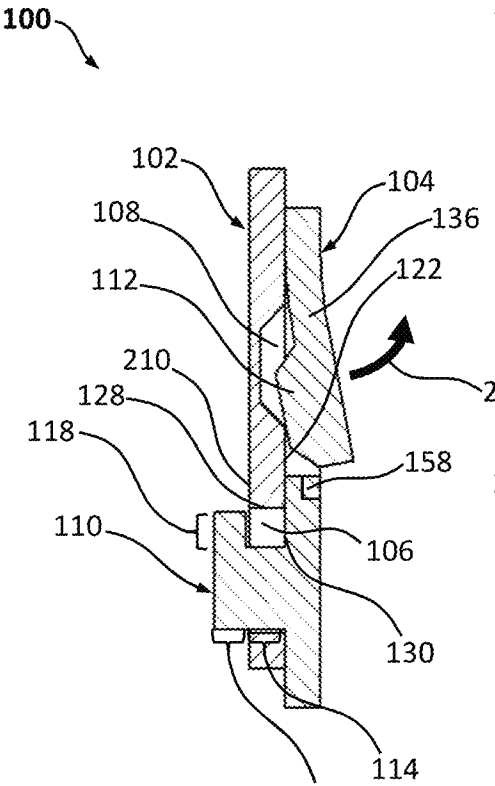
FIG. 2B
FIG. 2C

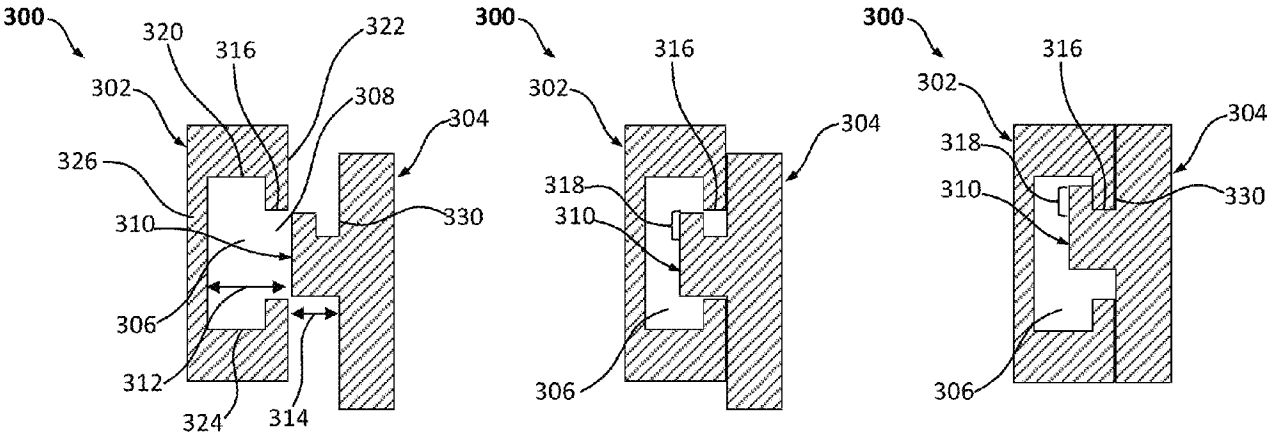
FIG. 3A
FIG. 3B
FIG. 3C
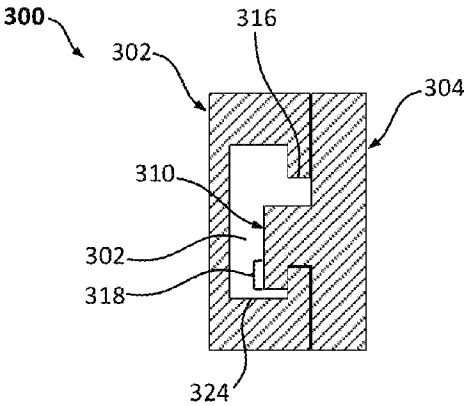
FIG. 3D

MECHANICAL SNAP CONNECTOR ASSEMBLY

CROSS-REFERENCE TO RELATED APPLICATIONS

This application claims priority to U.S. Provisional Application No. 61/803,791 filed with the U.S. Patent and Trademark Office on Mar. 21, 2013, the entire contents of which are hereby incorporated by reference.

BACKGROUND

1. Field

The present disclosure relates generally to connector assemblies and, more specifically, to mechanical snap connector assemblies.

2. Related Art

Mechanical snap connectors offer a simple, rapid, and economical way to join two or more components without the use of screws, clips, or adhesives. They are employed to assemble components in a wide range of applications such as toys, automobiles, furniture, modular robots, and consumer electronics. Typically, mechanical snap connectors include a protrusion on one component and a corresponding cavity on a second component. The two components may be quickly and easily joined by inserting the protrusion into the cavity, thereby engaging the protrusion with the cavity. Unlike mechanical fasteners (e.g., screws, bolts, rivets, etc.), mechanical snap connectors may be integrated with the components being joined, thereby reducing the number of components required for joining. Additionally, the mechanical snap connectors may be designed to be releasable, thereby allowing parts to be quickly and conveniently joined and released without the use of tools.

However, conventional mechanical snap connectors suffer from several drawbacks. For example, conventional mechanical snap connectors that are easily released typically do not provide a secure connection. Conversely, conventional mechanical snap connectors that provide a secure connection are typically difficult to release. In addition, conventional mechanical snap connectors are susceptible to wear and degradation after multiple joining and release operations, which result in an insecure or loose-fitting connection.

BRIEF SUMMARY

In an exemplary embodiment, a connector assembly has a first component and a second component. The first component includes a slot and an indentation and the second component includes a hook and a protrusion. The hook is configured to engage with the slot by being inserted into the slot and being translated with respect to the slot in a first direction parallel to a surface of the first component. When the hook is engaged with the slot, the hook is configured to resist movement of the second component with respect to the first component in a direction perpendicular to the surface of the first component. The protrusion is configured to at least partially depress with respect to a surface of the second component as the hook is inserted into the slot and engage with the indentation when the hook is positioned to engage with the slot. When the protrusion is engaged with the indentation, the protrusion is configured to resist movement of the second component with respect to the first component in a second direction parallel to the surface of the first component.

BRIEF DESCRIPTION OF THE DRAWINGS

FIGS. 2A-C illustrate cross-sectional views of an exemplary mechanical snap connector assembly in various stages of connection.

FIGS. 3A-D illustrate cross-sectional views of a hook and a socket of an exemplary mechanical snap connector assembly in various stages of engagement.

DETAILED DESCRIPTION

The following description is presented to enable a person of ordinary skill in the art to make and use the various embodiments. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the various embodiments. Thus, the various embodiments are not intended to be limited to the examples described herein and shown, but are to be accorded the scope consistent with the claims.

Figure 1:
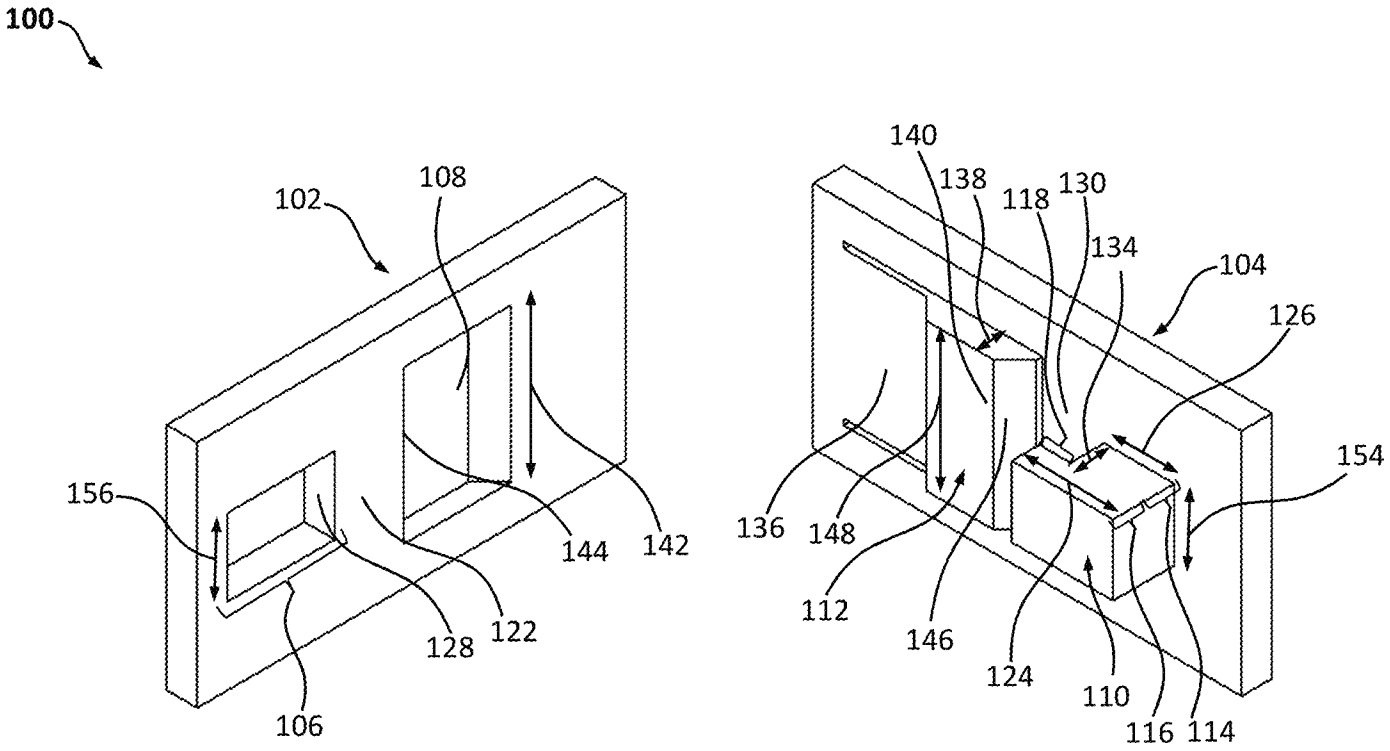
FIG. 1 illustrates a perspective view of an exemplary mechanical snap connector assembly.

FIG. 1 illustrates a perspective view of an exemplary mechanical snap connector assembly 100. Mechanical snap connector assembly 100 includes first component 102 having slot 106 and indentation 108 and second component 104 having hook 110 and protrusion 112. Hook 110 is configured to engage with slot 106 to resist separation of second component 104 from first component 102. Thus, hook 110 and slot 106 function to provide a strong connection. Protrusion 112 is configured to engage with indentation 108 to resist disengagement of hook 110 from slot 106. Thus protrusion 112 and indentation 108 function to provide a secure connection. Accordingly, first component 102 and second component 104 may be quickly and easily joined to form a strong and secure connection.

FIGS. 2A-C illustrate cross-sectional views of mechanical snap connector assembly 100 at various stages of connection. In particular, FIGS. 2A-C depict how hook 110 and protrusion 112 of second component 104 are configured to engage with slot 106 and indentation 108 of first component 102, respectively. Hook 110 is configured to engage with slot 106 by being inserted into slot 106 (as shown in FIGS. 2A and 2B) and being translated with respect to slot 106 in a direction indicated by arrow 206 that is parallel to surface 122 of first component 102 (as shown in FIGS. 2B and 2C). Hook 110 is configured to resist movement of second component 104 with respect to first component 102 in a direction indicated by arrow 204 that is perpendicular to surface 122 of first component 102 when hook 110 is engaged with slot 106. Accordingly, engaging hook 110 with slot 106 functions to resist second component 104 from separating from first component 102.

With reference to FIG. 2B, protrusion 112 is configured to at least partially depress (as depicted by arrow 202) with respect to surface 130 of second component 104 as hook 110 is inserted into slot 106. Specifically, protrusion 112 is configured to contact surface 122 of first component 102 as hook 110 is inserted into slot 106, thereby causing protrusion 112 to at least partially depress with respect to surface 130 of second component 104. With reference to FIG. 2C, protrusion 112 is configured to align with respect to indentation 108 and engage with indentation 108 when hook 110 is positioned to engage with slot 106. Protrusion 112 is configured to resist movement of second component 104 with respect to first component 102 in a direction indicated by arrow 208 that is parallel to surface 122 of first component 102. The direction indicated by arrow 208 is opposite to the direction indicated by arrow 206. Accordingly, engaging protrusion 112 with indentation 108 functions to resist hook 110 from disengaging from slot 106.

In the present example, with reference to FIG. 1, hook 110 includes stem portion 114 extending from surface 130 of second component 104 and head portion 116 extending from stem portion 114. Length 124 of head portion 116 is greater than length 126 of stem portion 114. Head portion 116 includes overhanging portion 118 that overhangs from stem portion 114. In this example, hook 110 is rigid and is configured to resist bending and twisting. Additionally, hook 110 is not tapered. As shown in FIG. 1, length 126 and width 154 of stem portion 114 remain approximately constant across height 134 of stem portion 114. Thus, hook 110 provides a strong and rigid connection between first component 102 and second component 104.

In the present example, as shown in FIGS. 2B and 2C, hook 110 is configured to engage with slot 106 by having head portion 116 of hook 110 inserting past through lip 128 of slot 106 and having hook 110 translated with respect to slot 106 in a direction indicated by arrow 206 that is parallel to surface 122 of first component 102 to position a portion of lip 128 of slot 106 between overhanging portion 118 and surface 130 of hook 110.

With reference back to FIG. 1, hook 110 and slot 106 are configured to resist rotation of first component 102 with respect to second component 104 when hook 110 is inserted into slot 106. In particular, width 154 of stem portion 114 of hook 110 forms a close fit with width 156 of slot 106 when hook 110 is engaged with slot 106, thereby resisting rotation of second component 104 with respect to first component 102 in a direction parallel to surface 122 of first component 102.

With reference to FIG. 2C, hook 110 is configured such that stem portion 114 is positioned adjacent to lip 128 of slot 106 when hook 110 is engaged to slot 106. Thus, hook 110 and slot 106 are configured to resist movement of second component 104 with respect to first component 102 in the direction indicated by arrow 206 when hook 110 is engaged with slot 106. In addition, hook 110 is configured such that overhanging portion 118 is positioned adjacent to back surface 210 of first component 102 when hook 110 is engaged to slot 106. Thus, hook 110 and slot 106 are configured to resist movement of second component 104 with respect to first component 102 in the direction indicated by arrow 204 that is perpendicular to surface 122 of first component 102 when hook 110 is engaged with slot 106.

Although in this example, hook 110 is depicted as an inverted L-shaped protrusion with a rectangular cross-section, it should be recognized that various other configurations may be implemented in place of hook 110 to achieve a similar or identical function as hook 110. For example, hook 110 may instead be a suitably configured protrusion having a head portion that overhangs a stem portion. In one example, the protrusion may be a hook similar to hook 110, but with an angled or curved head portion. In another example, the protrusion may be a pin having a head portion with a flange portion overhanging the stem of the pin. In yet another example, the protrusion may be a tab having a head portion with a barbed portion that overhangs the stem portion of the tab. The protrusion may have a circular cross-section or a polygonal cross-section. In some cases, the head portion of hook 110 may include multiple overhanging portions to enable hook 110 to engage with different lip portions of slot 106. For example, hook 110 may have a T-shaped configuration having two overhanging portions that are configured to engage with opposite lip portions of the slot.

In the present example, with reference to FIG. 1, slot 106 is a channel or a passage that extends through first component 102. However, it should be recognized that various other configurations may be used in place of slot 106 to achieve a similar or identical function as slot 106. For example, a suitably configured cavity may be used in place of slot 106. The cavity may generally have a lip, a rim, or an edge that is configured to engage between overhanging portion 118 of hook 110 and surface 130 of second component 104 in a similar or identical manner as described with reference to FIG. 1. In one example, the cavity may be a channel or a passage having a size, shape, or depth that is different from slot 106. In another example, the cavity may be a socket having a back wall. The socket may have a depth that is greater than the height at which hook 110 extends from surface 130.

FIGS. 3A-D illustrate cross-sectional views of an exemplary mechanical snap connector assembly 300 where socket 306 is used in place of a slot to engaged with hook 310. For convenience, only the portion of first component 302 having socket 306 and the portion of second component 304 having hook 310 are depicted in FIGS. 3A-D. With reference to FIG. 3A, socket 306 has an opening 308 at the surface 322 of first component 302. First component 302 is sufficiently thick such that socket 306 has a depth 312 that is greater than the height 314 of hook 310. In this example, socket 306 has a back wall 326, thereby forming a cavity within first component 302. However, in other cases, socket 306 may not have back wall 326, thereby forming a channel or passage through first component 302.

Sidewall 320 of socket 306 is recessed such that lip 316 of socket 306 overhangs sidewall 320. With reference to FIG. 3C, hook 310 is configured to engage with socket 306 by positioning lip 316 of socket 306 between overhanging portion 318 of hook 310 and surface 330 of second component 304. Further, socket 306 may have more than one sidewall that is recessed where hook 310 may engage with socket 306 in multiple directions. In this example, as shown in FIG. 3A, opposite sidewalls 320, 324 are recessed and thus hook 310 may engage with socket 306 in opposite directions as shown in FIGS. 3C and 3D.

In the present example, with reference back to FIG. 1, protrusion 112 has one side that is attached to second component 104 via a cantilever tab 136. In the absence of an applied force, protrusion 112 has an initial position where top surface 140 of protrusion 112 extends a distance 138 with respect to surface 130 of second component 104. In response to a force applied to protrusion 112 in a direction perpendicular to surface 130 of second component 104, protrusion 112 is configured to at least partially depress with respect to surface 130, thereby reducing the distance that top surface 140 of protrusion 112 extends with respect to surface 130 of second component 104. In addition, protrusion 112 is configured to resist depression by means of cantilever tab 136. Thus, protrusion 112, when depressed by an applied force, is configured to recover to its initial undepressed position in response to removing the applied force.

Although in this example, protrusion 112 is configured to resist depression by means of cantilever tab 136, it should be recognized that in other examples, various other configurations may be implemented to resist depression of protrusion 112. For example, in some cases, the protrusion may be a spring-loaded protrusion disposed at least partially within a channel of the second component. In other cases, protrusion may comprise a material capable of deforming and depressing in response to an applied force and recovering to its original shape in response to removing the applied force (e.g., an elastomer).

In the present example, as shown in FIG. 1, indentation 108 is an indentation on first component 102. Protrusion 112 and indentation 108 are configured to engage such that at least one surface of protrusion 112 closely fits with at least one corresponding surface of indentation 108, thereby resisting rotational and translational movement of second component 104 with respect to first component 102 in a direction parallel to surface 122 of first component 102. In the present example, with reference to FIGS. 1 and 2C, indentation 108 is a negative mapping of protrusion 112. Thus, in this example, protrusion 112 is configured such that top surface 140 and sidewalls of protrusion 112 form a close fit with corresponding bottom surface and sidewalls of indentation 108 when protrusion 112 is engaged with indentation 108.

FIGS. 2A-C illustrate how protrusion 112 is configured to operate during the connecting process. With simultaneous reference to FIGS. 1 and 2A, protrusion 112 and indentation 108 are configured such that length 148 of protrusion 112 aligns with respect to length 142 of indentation 108 when head portion 116 of hook 110 is aligned with respect to slot 106. With reference to FIG. 2B, protrusion 112 is configured such that top surface 140 contacts surface 122 of first component 102 as hook 110 is inserted into slot 106. As described above, top surface 140 of protrusion 112 extends a distance 138 with respect to surface 130 of second component 104. Distance 138 is such that top surface 140 of protrusion 112 contacts surface 122 of first component 102 before head portion 116 of hook 110 is inserted past lip 128 of slot 106. As head portion 116 is inserted past lip 128 of slot 106, protrusion 112 is configured to be pushed against surface 122 of first component 102. In response, surface 122 exerts a reactive force on protrusion 112 in a direction indicated by arrow 204 that is perpendicular to surface 130 of second component 104, which causes protrusion 112 to be at least partially depressed with respect to surface 130 of second component 104. As a result, the distance at which top surface 140 of protrusion 112 extends with respect to surface 130 of second component 104 reduces, thereby allowing head portion 116 of hook 110 to engage with slot 106.

With simultaneous reference to FIGS. 1 and 2C, protrusion 112 is configured to align with respect to indentation 108 when hook 110 is positioned to engage with slot 106. When protrusion 112 is aligned with respect to indentation 108, protrusion 112 is configured such that surface 122 of first component 102 no longer contacts top surface 140 of protrusion 112 and thus no longer exerts a reactive force on protrusion 112. In response to the absence of an applied force by surface 122, protrusion 112 recovers to its initial undepressed position by means of cantilever tab 136, and thus engages with indentation 108.

It should be recognized that protrusion 112 and indentation 108 may have various other configurations to achieve similar or identical functionality as described herein. For example, indentation 108 may be a cavity while protrusion 112 may be a protrusion having a size or shape that is different from protrusion 112. The cavity and protrusion may be configured such that one or more sidewalls of the cavity form a close fit with one or more corresponding sidewalls of the protrusion when hook 110 is positioned to engage with slot 106. In one example, the cavity may be a socket having a back wall. The depth of the socket may be such that top surface of the protrusion does not form a close fit with the back wall of the socket when the protrusion is engaged with the socket. In another example, the cavity may be a channel or passage that extends through the first component.

Figure 4:
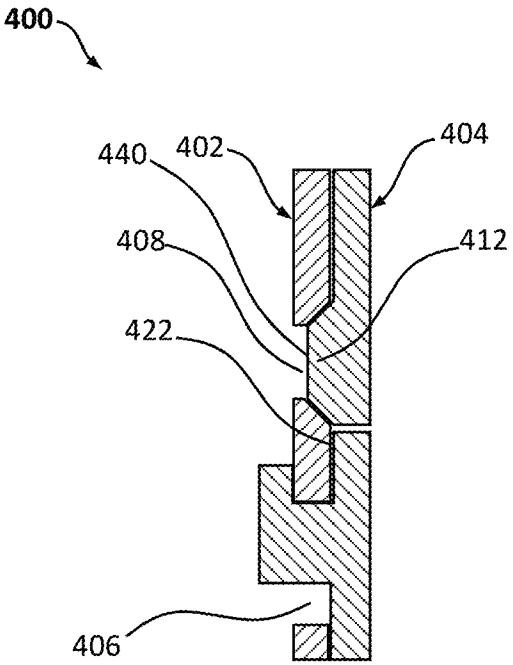
FIG. 4 illustrates a cross-sectional view of an exemplary mechanical snap connector assembly in a connected state.

FIG. 4 illustrates a cross-sectional view of an exemplary mechanical snap connector assembly 400 where cavity 408 takes the place of an indentation for first component 402. Cavity 408 extends through first component 402, thereby forming a channel or a passage through first component 402. As shown in FIG. 4, protrusion 412 of second component 404 and cavity 408 of first component 402 are configured such that only the sidewalls of protrusion 412 form a close fit with corresponding sidewalls of cavity 408 when protrusion 412 is engaged to cavity 408. Unlike the example described above with reference to FIG. 1, top surface 440 of protrusion 412 does not form a close fit with any surface of cavity 408. However, the close fit between corresponding sidewalls of protrusion 412 and cavity 408 enable protrusion 412 and cavity 408 to resist rotational and translational movement of second component 404 with respect to first component 402 in a direction parallel to surface 422 of first component 402. As described above, it should be appreciated that in some cases, cavity 408 may be a socket rather than a channel that is configured such that top surface 440 of protrusion 412 does not form a close fit with the back wall of the socket.

Figure 5:
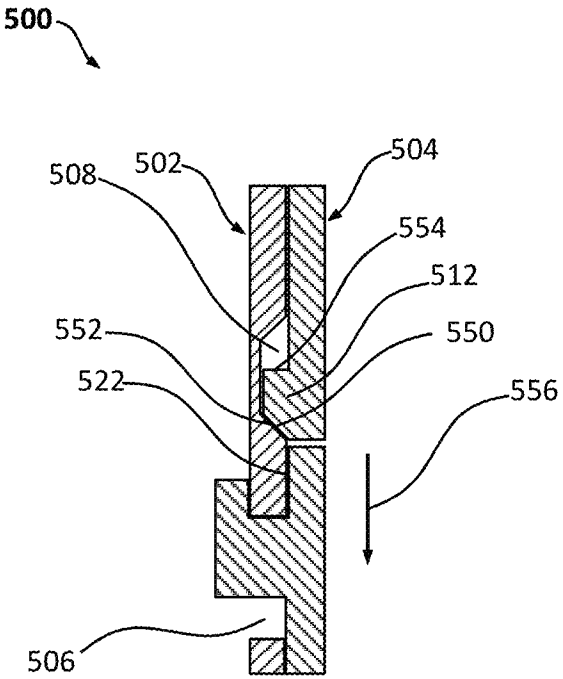
FIG. 5 illustrates a cross-sectional view of an exemplary mechanical snap connector assembly in a connected state.

FIG. 5 illustrates a cross-sectional view of an exemplary mechanical snap connector assembly 500 where second component 504 includes protrusion 512 having a configuration different from protrusion 112 of FIG. 1. In this example, protrusion 512 is configured such that not all the sidewalls of protrusion 512 form a close fit with corresponding sidewalls of indentation 508 when protrusion 512 is engaged with indentation 508. As shown in FIG. 5, protrusion 512 is configured such that sidewall 550 of protrusion 512 forms a close fit with corresponding sidewall 552 of indentation 508 when protrusion 512 is engaged to indentation 508. However, opposite sidewall 554 of protrusion 512 does not form a close fit with any sidewall of indentation 508. The close fit between sidewalls 550 and 552 still enables protrusion 512 and indentation 508 to resist rotational and translational movement of second component 504 with respect to first component 502 in a direction indicated by arrow 556 that is parallel to surface 522 of first component 502.

Figure 6:
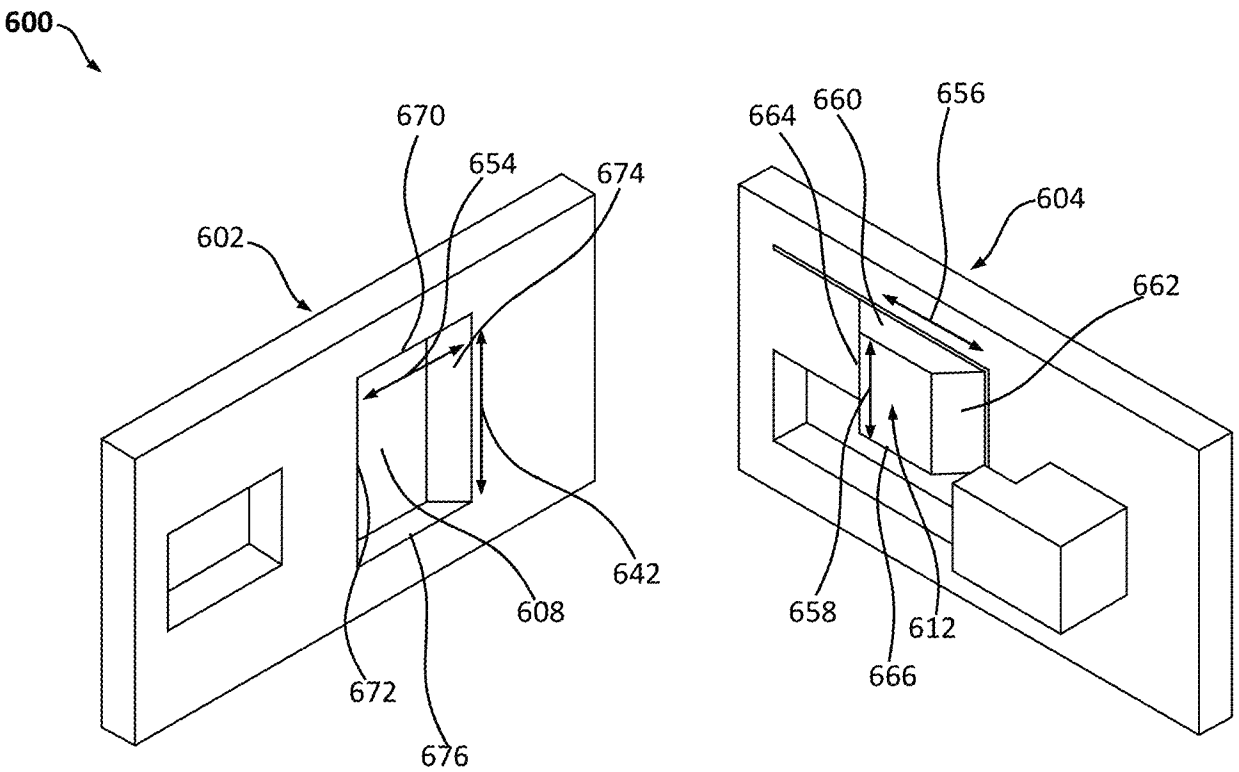
FIG. 6 illustrates a perspective view of an exemplary mechanical snap connector assembly.

FIG. 6 illustrates a cross-sectional view of an exemplary mechanical snap connector assembly 600 where second component 604 includes protrusion 612 having a configuration different from protrusion 112 of FIG. 1. In this example, protrusion 612 is configured to form a close fit with indentation 608 in a first dimension, but not in a second dimension that is perpendicular to the first dimension, when protrusion 612 is engaged with indentation 608. As shown in FIG. 6, protrusion 612 of second component 604 is configured to engage with indentation 608 of first component 602 such that width 656 of protrusion 612 forms a close fit with width 654 of indentation 608, but length 658 of protrusion 612 does not form a close fit with length 642 of indentation 608. Thus, a close fit is formed between sidewalls 662, 664 of protrusion 612 and sidewalls 672, 674 of indentation 608, respectively. Additionally, in this example, sidewall 660 of protrusion 612 forms a close fit with sidewall 670 of indentation 608. However, it should be recognized that in other examples, protrusion 612 may be positioned such that only one of or neither of sidewalls 660, 666 of protrusion 612 form a close fit with sidewalls 670, 676 of indentation 608, respectively.

Figure 7:
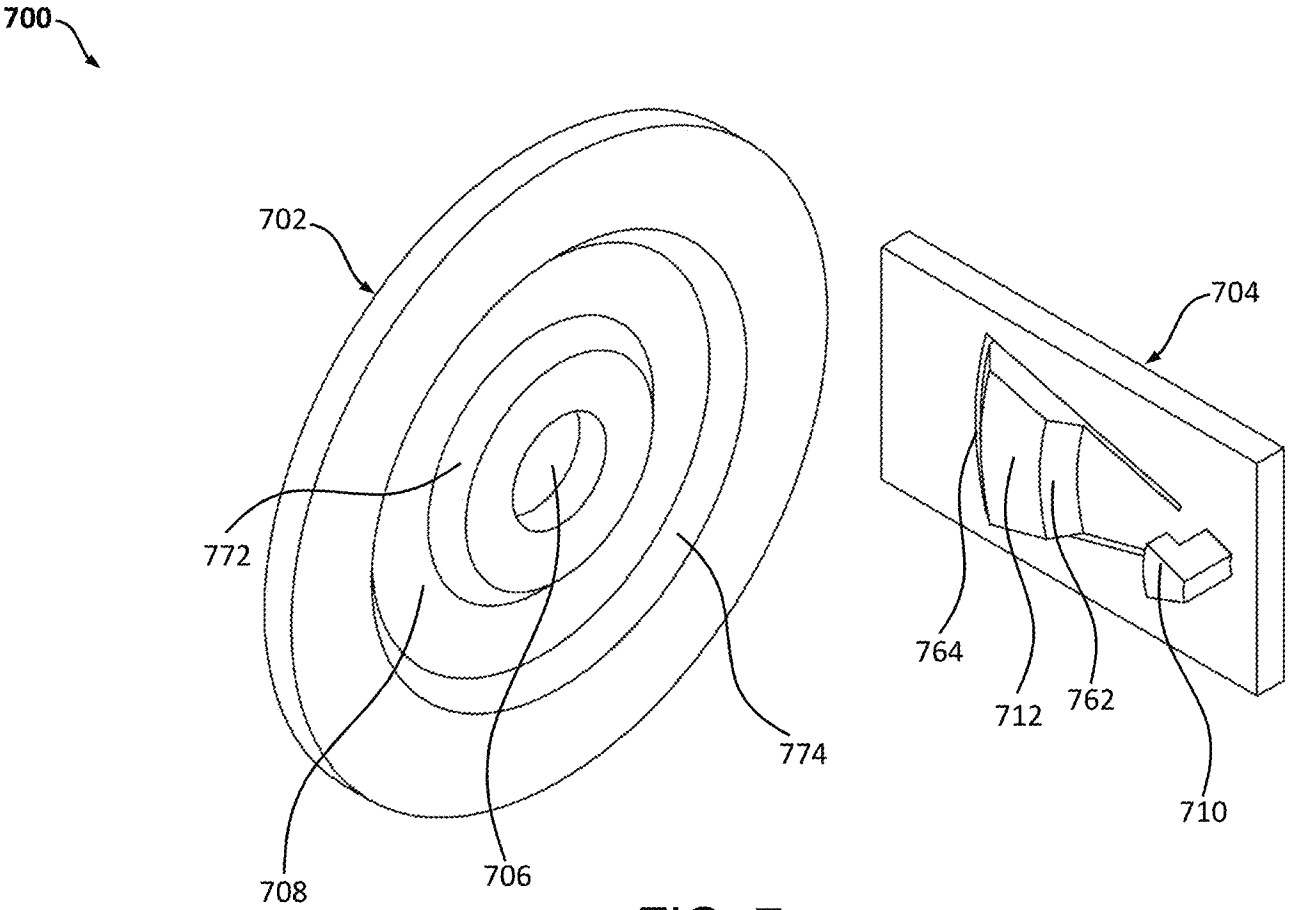
FIG. 7 illustrates a perspective view of an exemplary mechanical snap connector assembly.

FIG. 7 illustrates an exemplary mechanical snap connector assembly 700 where slot 706 of first component 702 has a circular configuration and indentation 706 of first component 702 has a concentric configuration with respect to slot 706. In this example, second component 704 is configured to connect with first component 702 in a radial position with respect to the center of first component 702 and at any angle with respect to a radius of first component 702. In particular, protrusion 712 and indentation 708 are configured to engage such that sidewalls 762, 764 of protrusion 712 form a close fit with sidewalls 772, 774 of indentation 708, respectively. Thus, protrusion 712 and indentation 708, when engaged, are configured to resist movement of second component 704 with respect to first component 702 in a radial direction with respect to the center of first component 702, thereby resisting disengagement of hook 710 from slot 706. In some cases, the concentric configuration of indentation 708 may enable protrusion 712 to be translated along the circular path of indentation 708. Thus, second component 704 may be rotated with respect to the center of first component 702 while second component 704 and first component 702 are connected.

In the present example, with reference back to FIGS. 2A-C, second component 104 is configured to disconnect from first component 102 by disengaging protrusion 112 from indentation 108 and subsequently disengaging hook 110 from slot 106. FIGS. 2A-C illustrate, in reverse order, how second component 104 is configured to disconnect from first component 102. With reference to FIG. 2C, protrusion 112 is configured to disengage from indentation 108 by being translated with respect to indentation 108 in a direction represented by arrow 208, thereby pushing sidewall 146 of protrusion 112 against sidewall 144 of indentation 108. Because sidewalls 144, 146 are tapered, pushing sidewall 146 of protrusion 112 against sidewall 144 of indentation 108 causes sidewall 144 of indentation 108 to exert a reactive force on protrusion 112 in a direction indicated by arrow 204 that is perpendicular to surface 122 of first component 102. With reference to FIG. 2B, the reactive force exerted by sidewall 144 on protrusion 112 causes protrusion 112 to at least partially depress with respect to surface 130 of second component 104, thereby enabling protrusion 112 to disengage with indentation 108. As protrusion 112 disengages with indentation 108, hook 110 is translated with respect to slot 106 in a direction indicated by arrow 208, thereby disengaging hook 110 from slot 106. With reference to FIG. 2A, hook 110 is removed from slot 106, and thus first component 102 and second component 104 are disconnected.

The force required to disengage protrusion 112 from indentation 108 is at least partially determined by the resistance of protrusion 112 to depression. A larger resistance to depression would require a greater force to disengage protrusion 112 from indentation 108. Conversely, a smaller resistance to depression would require a smaller force to disengage protrusion 112 from indentation 108. It should be recognized that protrusion 112 may be configured to resist depression to various degrees.

Further, the force required to disengage protrusion 112 from indentation 108 is at least partially determined by sidewall angles 150, 152 of sidewalls 146, 144, respectively. Sidewall angle 150 is defined as the angle of sidewall 146 of protrusion 112 with respect to a plane parallel to surface 130 of second component 104. Sidewall angle 152 is defined as the angle of sidewall 144 of indentation 108 with respect to a plane parallel to surface 122 of first component 102. In this example, sidewall angles 150, 152 are each approximately equal to 45 degrees. It should be recognized that in other examples, sidewall angles 150, 152 may be any angle greater or less than 45 degrees. A larger sidewall angle results in greater resistance to disengagement while a smaller sidewall angle results in less resistance to disengagement. In some cases, sidewall angle 150 may be different from sidewall angle 152.

Figure 8:
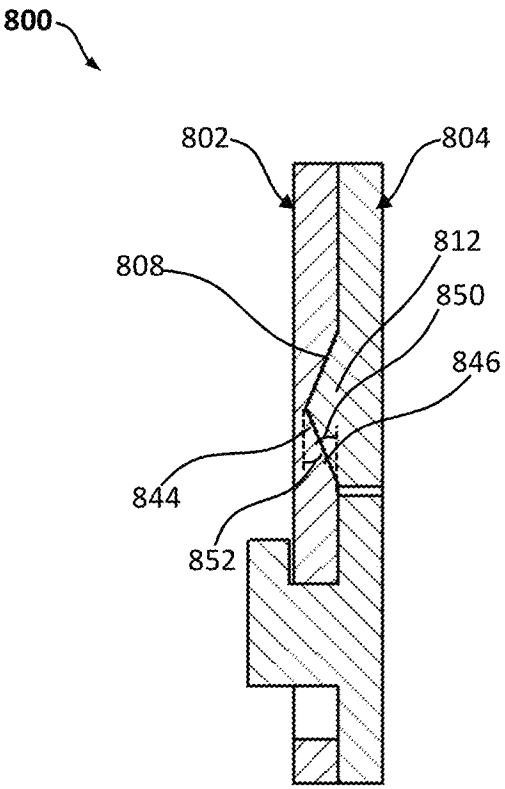
FIG. 8 illustrates a cross-sectional view of an exemplary mechanical snap connector assembly in a connected state.

FIG. 8 illustrates a cross-sectional view of an exemplary mechanical snap connector assembly 800. As shown in FIG. 8, sidewall angles 850, 852 of protrusion 812 and indentation 808, respectively, are both equal to approximately 22 degrees. Because sidewall angles 850, 852 are less than sidewall angles 150, 152 of FIG. 2C, respectively, a smaller force is required to disengage protrusion 812 from indentation 808 than to disengage protrusion 112 from indentation 108 of FIG. 2C.

Figure 9:
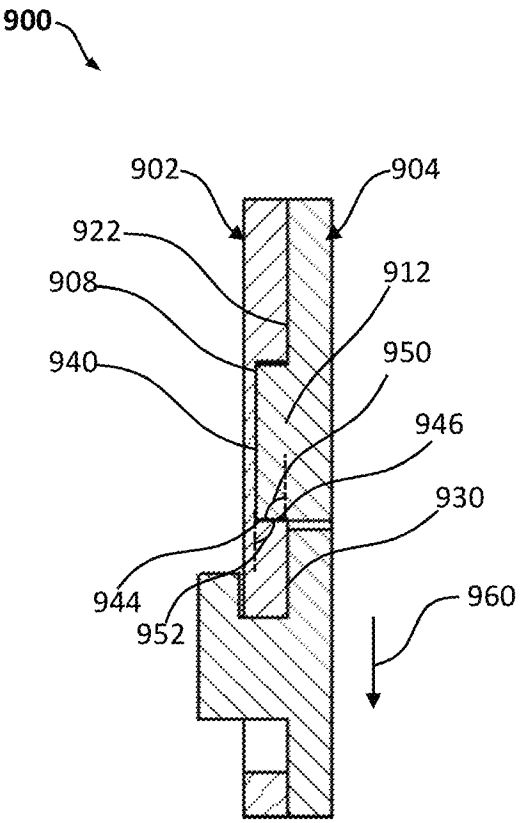
FIG. 9 illustrates a cross-sectional view of an exemplary mechanical snap connector assembly in a connected state.

FIG. 9 illustrates an exemplary mechanical snap connector assembly 900 where sidewall angles 950, 952 of protrusion 912 and indentation 908, respectively are both approximately 90 degrees. Sidewalls 944, 946 of indentation 908 and protrusion 912, respectively, are thus perpendicular to surfaces 922, 930 of first component 902 and second component 904, respectively. When sidewall 946 of protrusion 912 is pushed against sidewall 944 of indentation 908, sidewall 944 of indentation 908 exerts a reactive force on sidewall 946 of protrusion 912 in a direction parallel to surface 930 of second component 904, but not perpendicular to surface 930 of second component 904. Therefore, in response to translating protrusion 912 with respect to indentation 908 in a direction indicated by arrow 960, protrusion 912 does not depress with respect to surface 930 of second component 904 and as a result, protrusion 912 cannot disengage from indentation 908. Such a configuration may be advantageous in applications that require a very secure connection.

In some cases, the second component may include a locking mechanism (e.g., locking mechanism 158 depicted in FIGS. 2A-2C), which when engaged in a locking position with respect to the protrusion, is configured to further resist the depression of the protrusion with respect to the surface of the second component. Thus, the locking mechanism may function to further resist the protrusion from disengaging from the indentation and enable a more secure connection between the first component and the second component. It should be appreciated that the depiction of locking mechanism 158 in FIGS. 2A-2C is not intended to describe any specific shape or position of locking mechanism 158 on second component 104.

Although in the exemplary mechanical snap connector assemblies described above, the first component includes a slot and an indentation and the second component includes a hook and a protrusion, it should be recognized that in other examples, the first component and the second component may include various combinations of hooks, protrusions, slots, and indentations. For example, the first component may include a slot and a protrusion and the second component may include a hook and an indentation. In another example, the first component may include a hook and an indentation and the second component may include a slot and a protrusion.

Figures 10, 11:
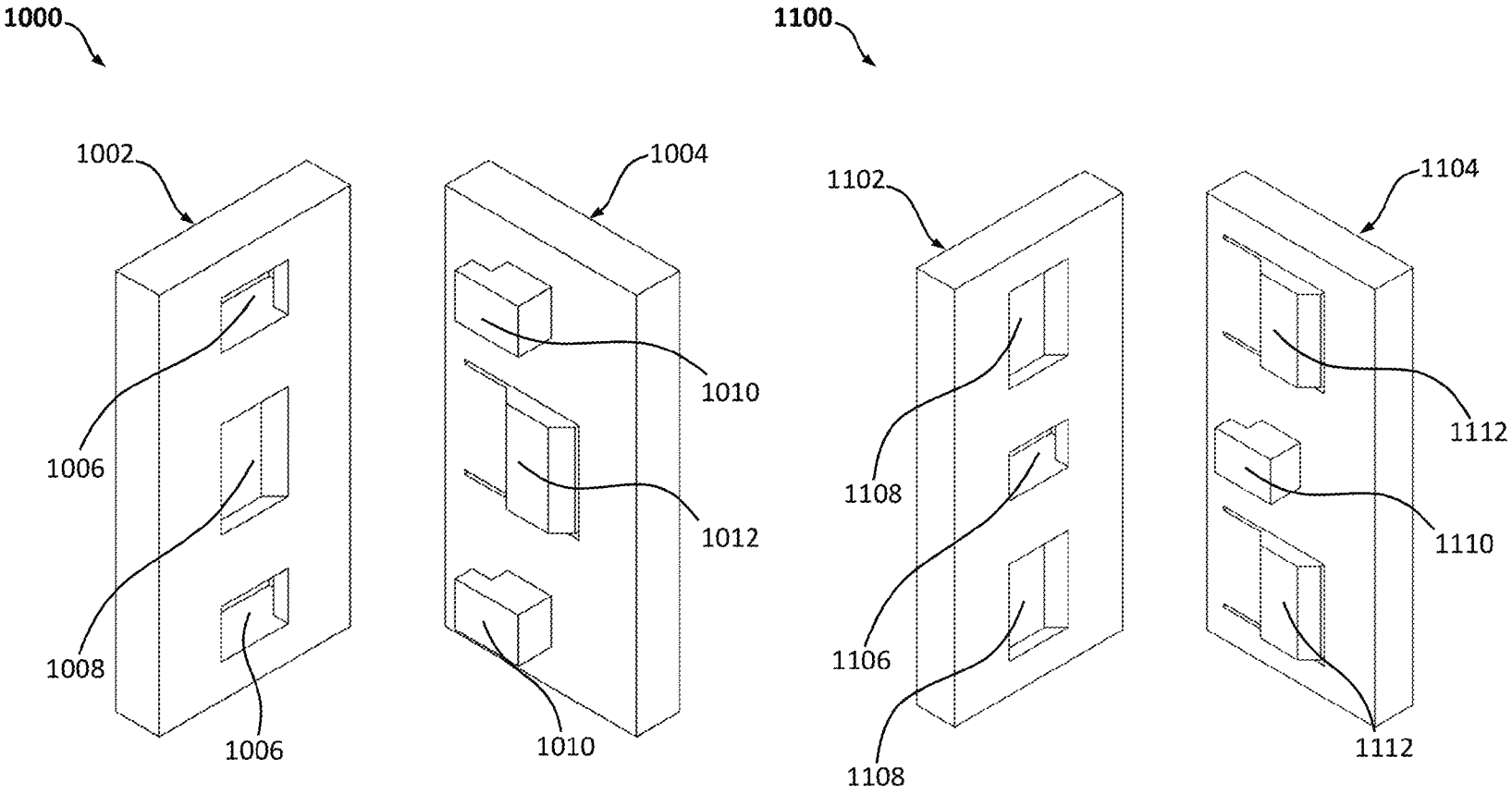
FIG. 10 illustrates a perspective view of an exemplary mechanical snap connector assembly.
FIG. 11 illustrates a perspective view of an exemplary mechanical snap connector assembly.

Further, it should be recognized that the first component may have any number of slots and indentations and the second component may have a corresponding number of hooks and protrusions. For example, FIG. 10 illustrates an exemplary mechanical snap connector assembly 1000 having multiple slots and a corresponding number of hooks. As shown in FIG. 10, first component 1002 includes a pair of slots 1006 disposed on opposite sides of indentation 1008 and second component 1004 includes a corresponding pair of hooks 1010 disposed on opposite sides of protrusion 1012. Pair of hooks 1010 and protrusion 1012 of second component 1004 are configured to engage with pair of slots 1006 and indentation 1008 of first component 1002, respectively. Slot 1006, indentation 1008, hook 1010, and protrusion 1012 are similar or identical to slot 106, indentation 108, hook 110, and protrusion 112 of FIG. 1, respectively. Having multiple hooks and slots provides greater resistance against movement of second component 1004 with respect to first component 1002 in a direction perpendicular to the surface of the first component, which results in a stronger connection.

FIG. 11 illustrates an exemplary mechanical snap connector assembly 1100 having multiple indentations and a corresponding number of protrusions. As shown in FIG. 11, first component 1102 includes a pair of indentations 1108 disposed on opposite sides of slot 1106 and second component 1104 includes a corresponding pair of protrusions 1112 disposed on opposite sides of hook 1110. Hook 1110 and pair of protrusions 1112 are configured to engage with slot 1106 and pair of indentations 1108, respectively. Slot 1106, indentation 1108, hook 1110, and protrusion 1112 are similar or identical to slot 106, indentation 108, hook 110, and protrusion 112 of FIG. 1, respectively. Having multiple protrusions and indentations provides greater resistance against hook 1110 disengaging from slot 1106 and thus results in a more secure connection.

Figure 12:
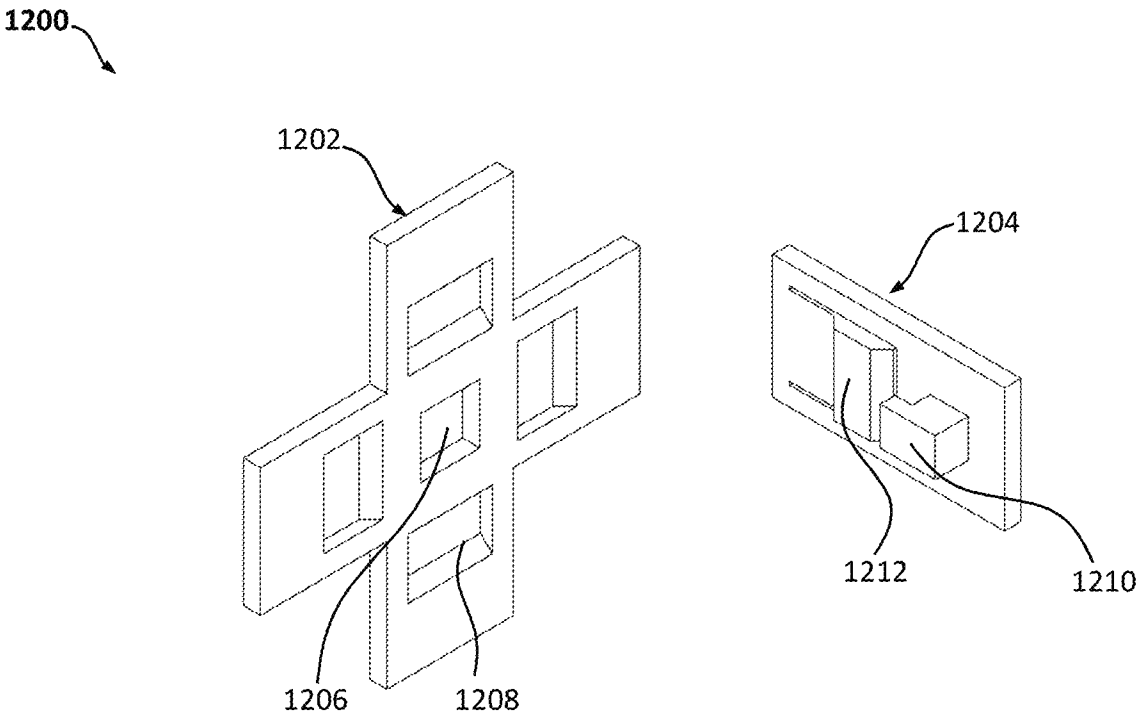
FIG. 12 illustrates a perspective view of an exemplary mechanical snap connector assembly.

FIG. 12 illustrates an exemplary mechanical snap connector assembly 1200 having first component 1202 with multiple indentations 1208. Such a configuration is advantageous in enabling second component 1204 to connect with first component 1202 in various directions. As shown in FIG. 12, first component 1202 includes slot 1206 surrounded by four indentations 1208. Second component 1204 includes hook 1210 that is configured to engage with slot 1206 and protrusion 1212 that is configured to engage with any one of the four indentations 1208. Slot 1206, indentation 1208, hook 1210, and protrusion 1212 are similar or identical to slot 106, indentation 108, hook 110, and protrusion 112 of FIG. 1, respectively. Thus, second component 1204 is configured to connect with first component 1202 in any one of four directions.

Although in the examples described above, the first component and the second component have planar configurations, it should be recognized that the first component and the second component may have various other shapes and configurations for various applications. For example, the first component and the second component may be components for the assembly of toys, automobiles, furniture, modular robots, home storage solutions, or consumer electronics. In addition, more than two components may be configured to join together in a similar manner as described above.

Figure 13B:
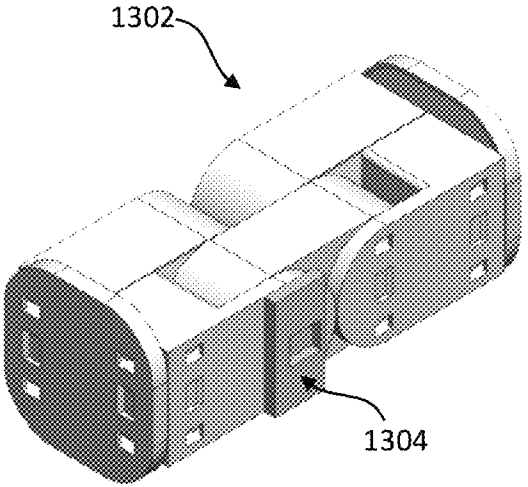
FIGS. 13A-B illustrate an exemplary mechanical snap connector assembly used to connect a connector plate to a modular robot.
Figure 13A:
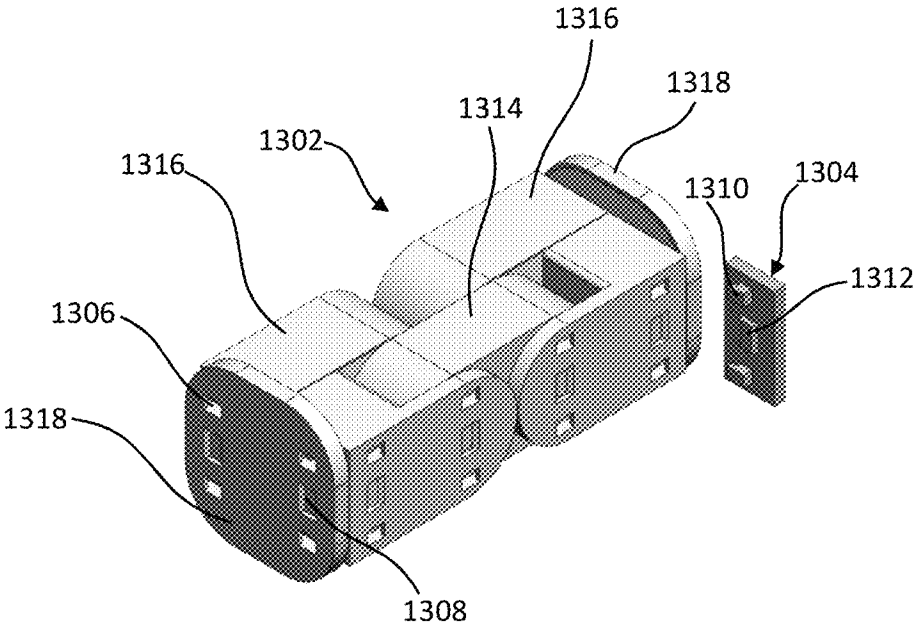

In one exemplary application, mechanical snap connector assemblies may be used to quickly, securely, and releasably connect modular robots together or connect various components to modular robots. For example, FIGS. 13A-C illustrate an exemplary mechanical snap connector assembly used to connect connector plate 1304 to modular robot 1302. With reference to FIG. 13A, connector plate 1304 includes a pair of hooks 1310 disposed on opposite sides of protrusion 1312. Hook 1310 and protrusion 1312 are similar or identical to hook 110 and protrusion 112 of FIG. 1, respectively. Modular robot 1302 includes two outer sections 1316 attached on opposite ends of center section 1314. Rotating faceplates 1318 are attached to the ends of each outer section 1316. Modular robot 1302 has four degrees of freedom where each of the two outer sections 1316 can rotate 180 degrees with respect to center section 1314 and each of faceplates 1318 can rotate continuously in a clockwise or counterclockwise direction with respect to the outer sections 1316. It should be recognized that modular robot 1302 may have various other configurations that enable various movements and degrees of freedom.

Modular robot 1302 includes a pattern of four slots 1306 and two indentations 1308 disposed on each of the opposite sides of outer sections 1316 and each of faceplates 1318. Slot 1306 and indentation 1308 are similar or identical to slot 106 and indentation 108 of FIG. 1, respectively. It should be recognized that modular robot 1302 may have various other patterns of slots 1306 and indentations 1308.

In some cases, modular robot 1302 may include a pattern of slots 1306 and protrusions 1312 or a pattern of indentations 1308 and hooks 1310.

Connector plate 1304 is configured to connect with each of the opposite sides of outer sections 1316 and each of faceplates 1318 of modular robot 1302. As shown in FIG. 13B, connector plate 1304 is connected with a side of outer section 1316 of modular robot 1302. In this example, each indentation 1308 of modular robot 1302 is positioned symmetrically between a pair of slots 1306. Similarly, protrusion 1312 of connector plate 1304 is positioned symmetrically between the pair of hooks 1310. Connector plate 1304 may thus be connected to modular robot 1302 such that pair of hooks 1310 is orientated in one direction or, alternatively, in an opposite direction with respect to a corresponding pair of slots 1306.

Figure 14B:
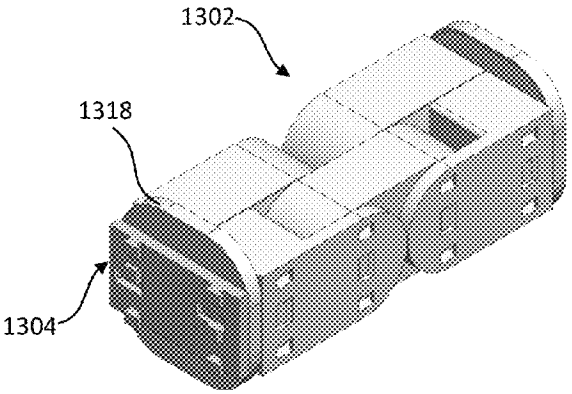
FIGS. 14A-C illustrate an exemplary mechanical snap connector assembly used to connect two modular robots.
Figure 14A:
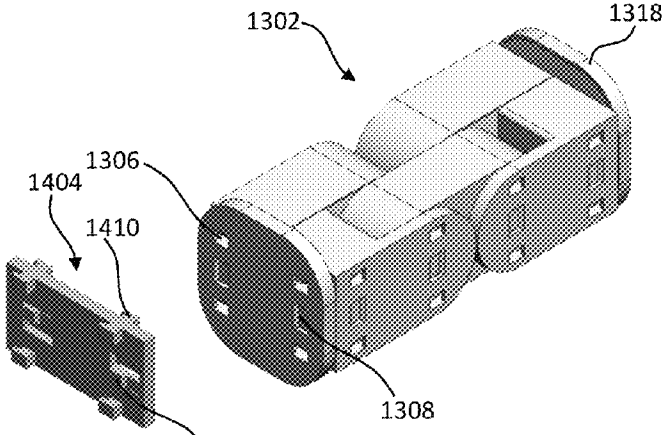
Figure 14C:
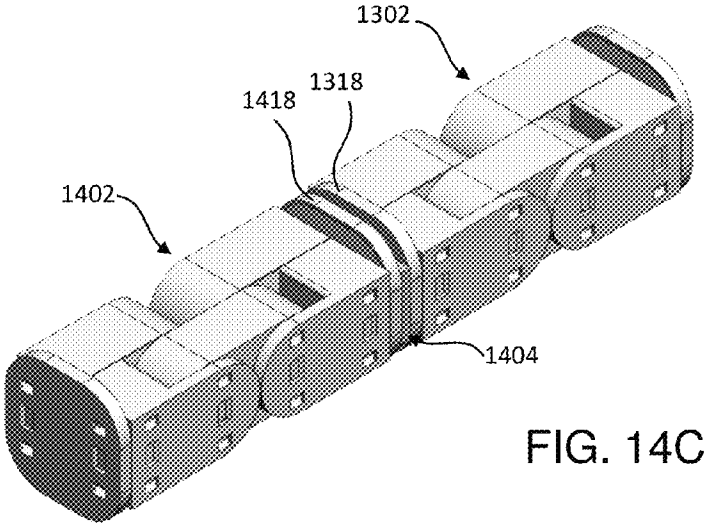

FIGS. 14A-C illustrate an exemplary mechanical snap connector assembly used to connect modular robot 1302 and second modular robot 1402. Second modular robot 1402 is similar or identical to modular robot 1302. With reference to FIG. 14A, connector plate 1404 is configured to connect with a side of outer section 1316 of modular robot 1302 or a faceplate 1318 of modular robot 1302. Each of the opposite sides of connector plate 1404 has a pattern of four hooks 1410 and two protrusions 1412. The pattern is complementary to the pattern of four slots and two indentations on modular robot 1302 and second modular robot 1304. Hook 1410 is similar or identical to hook 110 of FIG. 1. Protrusions 1412 are similar to protrusion 612 of FIG. 6 where protrusions 1412 form a close fit with indentations 1308 in a first dimension but not in a second dimension that is perpendicular to the first dimension. Such a configuration enables protrusions 1412 to function when positioned on opposite sides of second component 1404. With reference to FIG. 14B, one side of connector plate 1404 is connected to faceplate 1318 of modular robot 1302. With reference to FIG. 14C, faceplate 1418 of second modular robot 1402 is connected to the opposite side of connector plate 1404. Accordingly, modular robot 1302 is connected to second modular robot 1402 via connector plate 1404 in a longitudinal configuration.

Figure 15B:
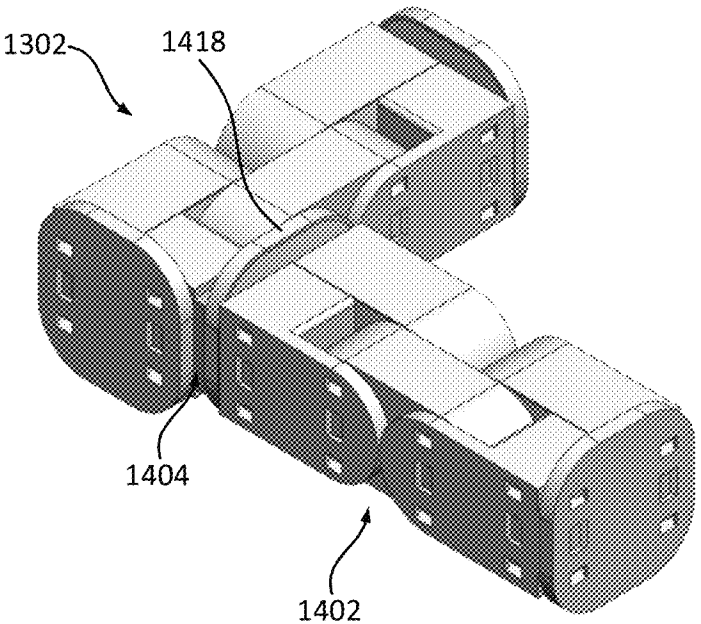
FIGS. 15A-B illustrate an exemplary mechanical snap connector assembly used to connect two modular robots.
Figure 15A:
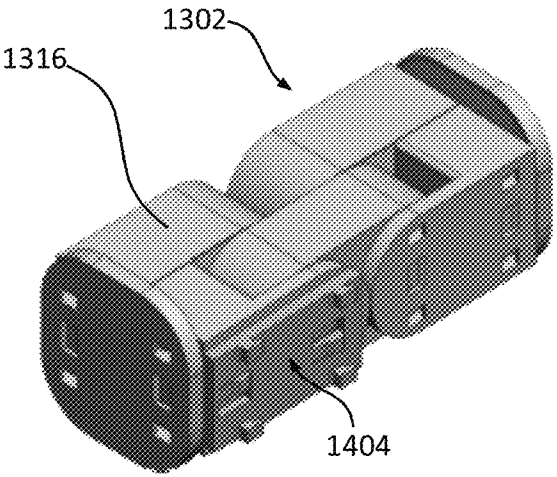

It should be recognized that connector plate 1404 may be used to connect modular robot 1302 and second modular robot 1402 in various other configurations. For example, with reference to FIG. 15A, one side of connector plate 1404 is connected to outer section 1316, instead of faceplate 1318 of modular robot 1302. With reference to FIG. 15B, faceplate 1418 of second modular robot 1402 is connected to the opposite side of connector plate 1404. Accordingly, modular robot 1302 is connected to second modular robot 1402 via connector plate 1404 in an L-shaped configuration.

Figure 16B:
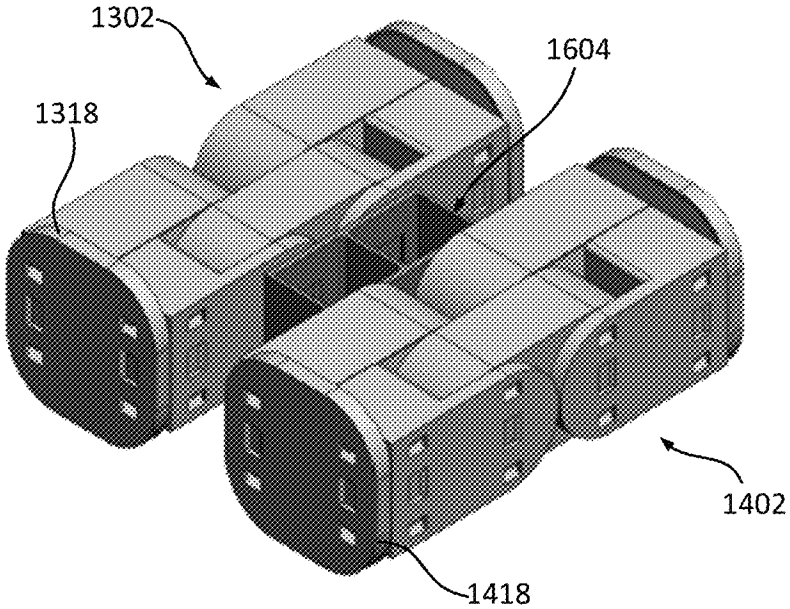
FIG. 16A-B illustrate an exemplary mechanical snap connector assembly used to connect two modular robots.
Figure 16A:
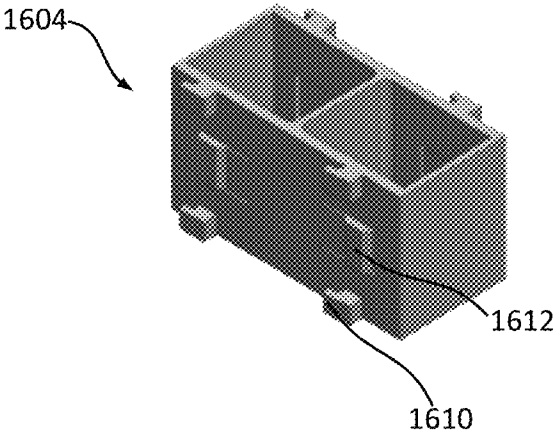

FIGS. 16A-B illustrate an exemplary mechanical snap connector assembly used to connect modular robot 1302 and second modular robot 1402. FIG. 16A depicts connector block 1604 having a pattern of four hooks 1610 and two protrusions 1612 disposed on opposite sides of connector block 1604. The pattern is similar or identical to that of connector plate 1404 of FIG. 14A. Hook 1610 and protrusion 1612 are similar or identical to hook 110 and protrusion 112 of FIG. 1, respectively. With reference to FIG. 16B, modular robot 1302 and second modular robot 1402 are connected to opposite sides of connector block 1604. Connector block 1604 is configured to allow sufficient clearance between modular robot 1302 and second modular robot 1402 such that faceplates 1318, 1418 of modular robot 1302 and second modular robot 1402, respectively, may rotate freely without interference.

Figure 17B:
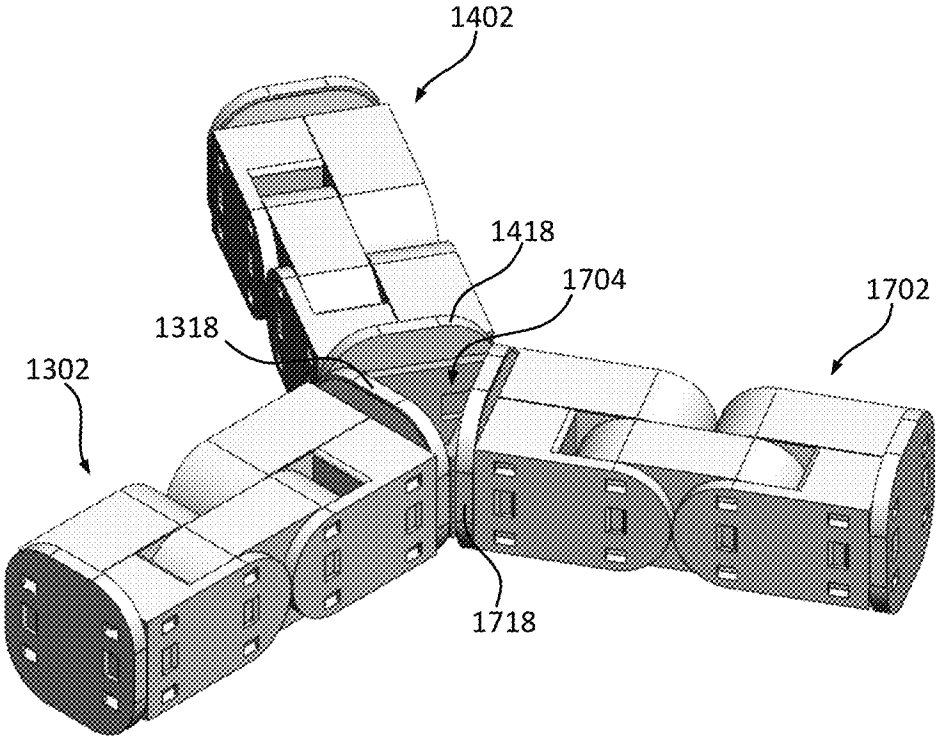
FIG. 17A-B illustrate an exemplary mechanical snap connector assembly used to connect three modular robots.
Figure 17A:
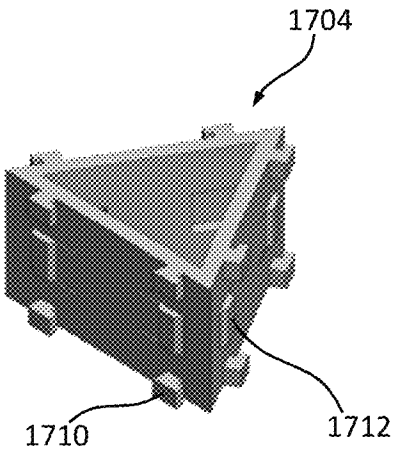

FIGS. 17A-B illustrate an exemplary mechanical snap connector assembly used to connect three modular robots. FIG. 17A depicts an exemplary connector block 1704 that is configured to connect three modular robots together. Connector block 1704 includes three faces arranged in a triangular configuration. Each face of connector block 1704 includes a pattern of four hooks and two protrusions that is similar or identical to that of connector plate 1404 of FIG. 14A. With reference to FIG. 17B, modular robot 1302, second modular robot 1402, and third modular robot 1702 are connected to each face of connector block 1704 to form a three-legged walking robot. Third modular robot 1702 is similar or identical to modular robot 1302. Modular robot 1302, second modular robot 1402, and third modular robot 1702 connect to block 1704 via faceplates 1318, 1418, 1718 of modular robot 1302, second modular robot 1402, and third modular robot 1702, respectively.

Figure 18:
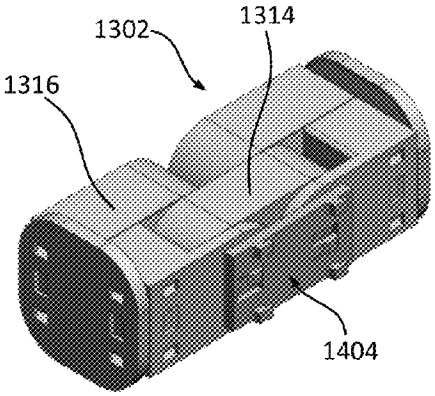
FIG. 18 illustrates an exemplary mechanical snap connector assembly used to restrict the motion of a modular robot.

FIG. 18 illustrates an exemplary mechanical snap connector assembly used to restrict the motion of modular robot 1302. As shown in FIG. 18, connector plate 1404 is configured to connect across the two outer sections 1316 of modular robot 1302, thereby bridging the gap between the two outer sections 1316. In this way, connector plate 1404 locks the two outer sections 1316 of modular robot 1302 and thus restricts the motion of the two outer sections 1316 with respect to center section 1314 of modular robot 1302.

Figure 19:
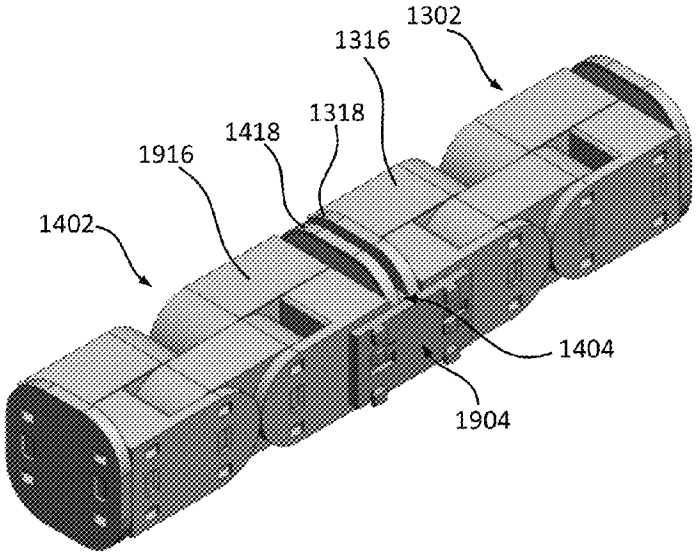
FIG. 19 illustrates an exemplary mechanical snap connector assembly used to restrict the motion of two modular robots.

FIG. 19 illustrates an exemplary mechanical snap connector assembly used to restrict the motion of modular robot 1302 and second modular robot 1402. As shown in FIG. 19, modular robot 1302 is connected to second modular robot 1402 via connector plate 1404 in a similar or identical manner as described with respect to FIGS. 14A-C. Additionally, second connector plate 1904 is connected across outer section 1316 of modular robot 1302 and outer section 1916 of second modular robot 1402, thereby locking the two outer sections 1316, 1916 together. Second connector plate 1904 is similar or identical to connector plate 1404 of FIG. 14A. Second connector plate 1904 thus restricts the rotation of faceplate 1418 of second modular robot 1402 with respect to faceplate 1318 of modular robot 1302 and vice versa.

Figure 20A:
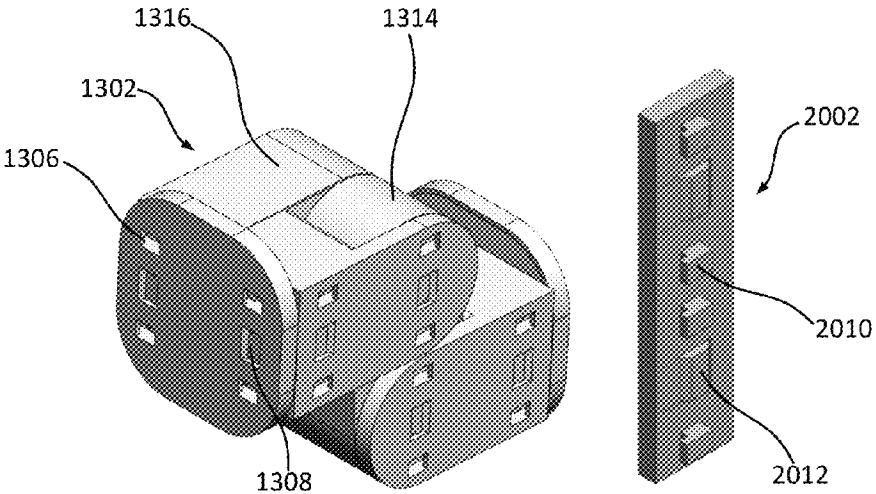
FIGS. 20A-B illustrate an exemplary mechanical snap connector assembly used to restrict the motion of a modular robot.
Figure 20B:
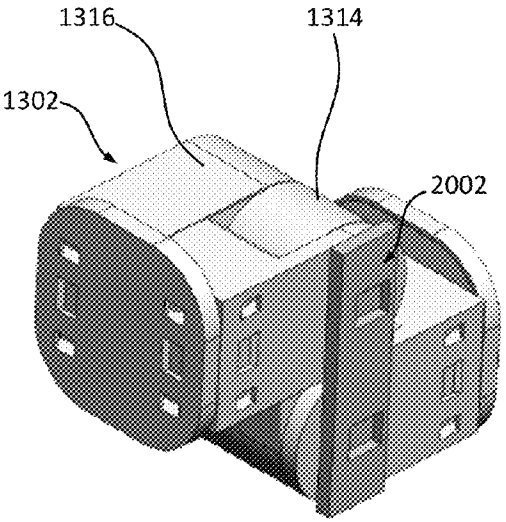

FIGS. 20A-B illustrate an exemplary mechanical snap connector assembly used to restrict the motion of a modular robot. As shown in FIG. 20A, outer sections 1316 of modular robot 1302 are bent approximately orthogonal with respect to center section 1314. Connector plate 2002 includes two protrusions 2012 with a pair of hooks 2010 disposed on opposite sides of each protrusion 2012. Hooks 2010 and protrusions 2012 of connector plate 2002 are in vertical alignment. Hook 2010 and protrusion 2012 are similar or identical to hook 110 and protrusion 112 of FIG. 1, respectively. With reference to FIG. 20B, second component 2002 is configured to connect to first component 1302 such that the two outer sections 1316 are joined together in a stacked configuration. Second component 2002 thus functions to lock the two outer sections 1316 in a bent position with respect to center section 1314 and restrict the motion of the two outer sections 1316 with respect to the center section 1314.

Figure 21B:
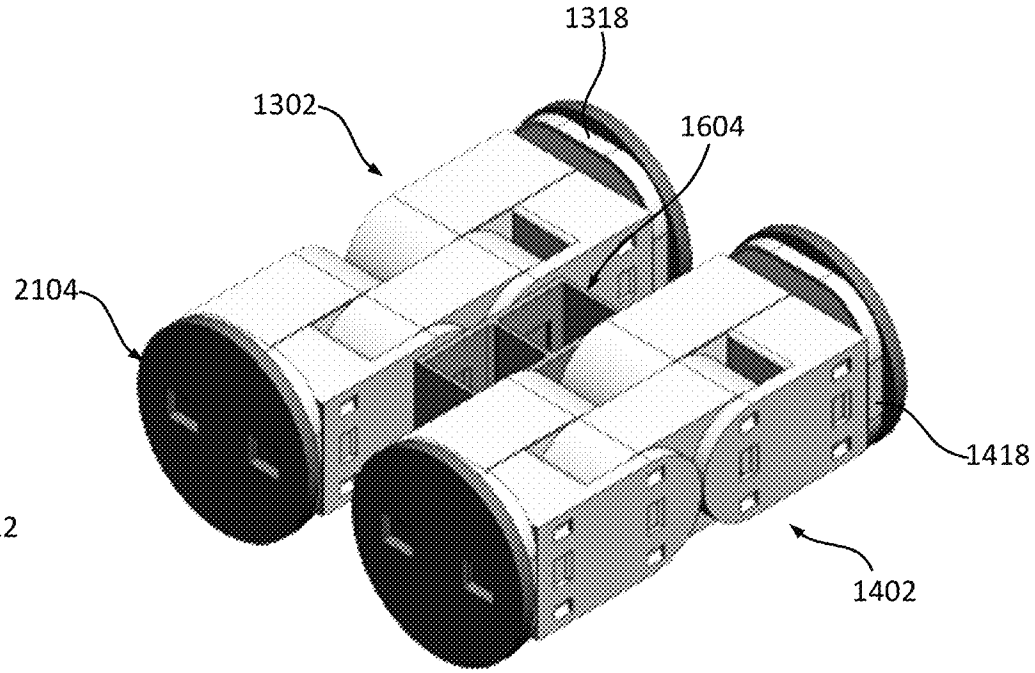
FIGS. 21A-B illustrate an exemplary mechanical snap connector assembly used to connect accessories to modular robots.
Figure 21A:
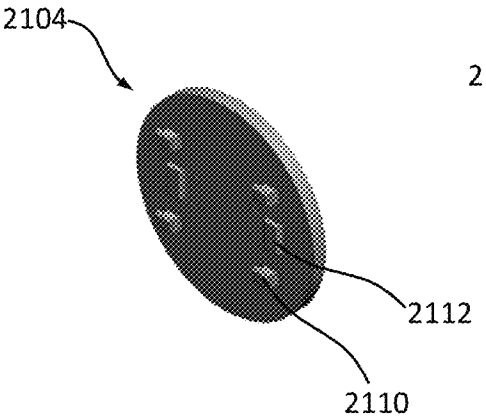

FIGS. 21A-B illustrate an exemplary mechanical snap connector assembly used to connect modular robot accessories to modular robots. As shown in FIG. 21A, wheel 2104 includes a pattern of four hooks 2110 and two protrusions 2112 that is similar or identical to that of connector plate 1404 of FIG. 14A. Hook 2110 and protrusion 2112 are similar or identical to hook 110 and protrusion 112 of FIG. 1, respectively. Wheel 2104 is an accessory that may be connected with modular robots to increase the functionality of the modular robots. For example, as shown in FIG. 21B, modular robot 1302 and second modular robot 1402 are connected together by connector block 1604 in a similar manner as described above with reference to FIG. 16B. In addition, four wheels 2104 are connected to each of faceplates 1318, 1418 of modular robot 1302 and second modular robot 1402, respectively, to form a four-wheel-drive vehicle.

Figure 22B:
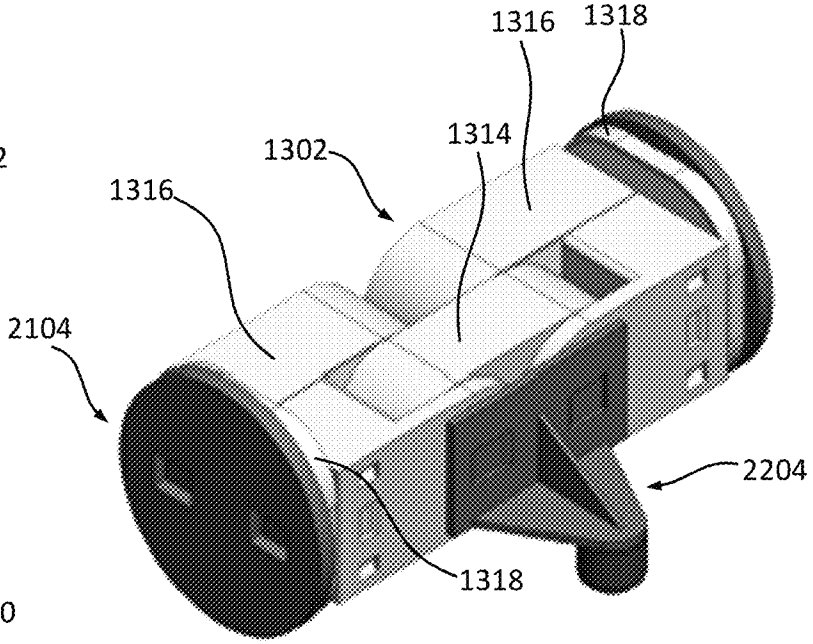
FIGS. 22A-B illustrate an exemplary mechanical snap connector assembly used to connect accessories to modular robots.
Figure 22A:
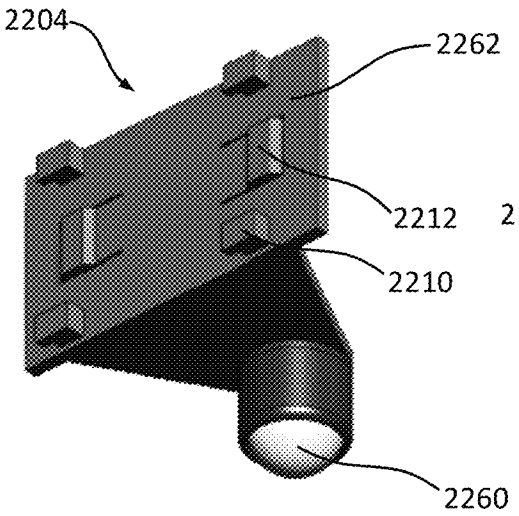

FIGS. 22A-B illustrate an exemplary mechanical snap connector assembly used to connect modular robot accessories to a modular robot. FIG. 22A illustrates castor ball assembly 2204 having castor ball 2260 and connecting interface 2262. Connecting interface 2262 includes a pattern of four hooks 2210 and two protrusions 2212 that is similar or identical to that of connector plate 1404 in FIG. 14A. Hook 2210 and protrusion 2212 are similar or identical to hook 110 and protrusion 112 of FIG. 1, respectively. As shown in FIG. 22B, castor ball assembly 2204 is connected across the two outer sections 1316 of modular robot 1302 via connecting interface 2262 to provide balance and support for modular robot 1302 and to resist rotation of outer sections 1316 and center section 1314 of modular robot 1302 when faceplates 1318 rotate. Wheels 2104 are connected to the opposite faceplates 1318 of modular robot 1302 in a similar manner as described above with reference to FIG. 21B.

In accordance with the examples described above, it should be recognized that various other configurations of connector blocks and connector plates may exist to enable multiple modular robots to be connected in various configurations or to restrict movement of modular robots in various ways. Additionally, various other modular robot accessories that are configured to connect with modular robots may exist to add various other functionalities to the modular robots. For example, modular robot accessories may include grippers and sensors.

Figure 23:
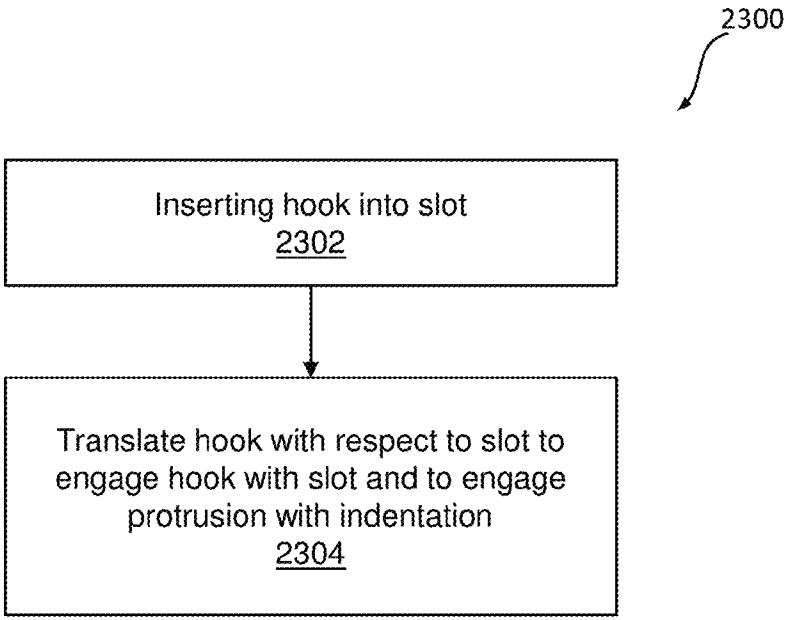
FIG. 23 illustrates an exemplary process for connecting a first component and a second component of a mechanical snap connector assembly.

FIG. 23 illustrates an exemplary process 2300 for connecting a first component and a second component of a mechanical snap connector assembly. In the present example, with reference to FIGS. 1 and 2A-C, exemplary process 2300 is used to connect first component 102 and second component 104 together. Exemplary process 2300 is described below with simultaneous reference to FIGS. 2A-C and FIG. 23.

At block 2302 and as shown in FIGS. 2A and 2B, hook 110 is inserted into slot 106. As hook 110 is inserted into slot 106, protrusion 112 is at least partially depressed with respect to surface 130 of second component 104.

At block 2304 and as shown in FIG. 2C, hook 110 is translated with respect to slot 106 in a direction indicated by arrow 206 that is parallel to surface 122 of first component 102 to engage hook 110 with slot 106. Protrusion 112 engages with indentation 108 when hook 110 is positioned to engage with slot 106.

Hook 110 resists movement of second component 104 with respect to first component 102 in a direction indicated by arrow 204 that is perpendicular to surface 122 of first component 102 when hook 110 is engaged with slot 106. Protrusion 112 resists movement of second component 104 with respect to first component 102 in a direction indicated by arrow 208 that is parallel to surface 122 of first component 102 when protrusion 112 is engaged with indentation 108.

It should be recognized that exemplary process 2300 may be used to connect a first component and a second component having various other configurations in accordance with the examples described above. For example, exemplary process 2300 may be used to connect a modular robot to a second modular robot or a connector block, a connector plate, or a modular robot accessory to a modular robot.

Although the invention has been described in conjunction with particular embodiments, it should be appreciated that various modifications and alterations may be made by those skilled in the art without departing from the spirit and scope of the invention. For example, the slot/indentation and hook/protrusion pairings (i.e., slot-hook pair and indentation-protrusion pair) described above may be viewed as female and male pairings. Thus, the slot may be a first female element, with the hook being a first male element. The first female element and first male elements may be suitably configured to achieve similar or identical functionalities as the slot and hook described above. Similarly, the indentation may be a second female element, with the protrusion being a second male element. The second female element and second male elements may be suitably configured to achieve similar or identical functionalities as the indentation and protrusion described above. Alternatively, the slot and the indentation described above may be a first cavity and second cavity, respectively. The first cavity and the second cavity may be suitably configured to achieve similar or identical functionalities as the slot and the indentation, respectively, described above. The first cavity and the second cavity may each be a channel or a passage that extends through a component of the mechanical snap connector assembly or a socket having an enclosed back wall. Similarly, the hook and the protrusion described herein may instead be a first protrusion and a second protrusion, respectively. The first protrusion and the second protrusion may be suitably configured to achieve similar or identical functionalities as the hook and the protrusion, respectively, described above. Further, embodiments may be combined and aspects described in connection with an embodiment may stand alone. The invention is not to be limited by the foregoing illustrative details, but rather is to be defined by the appended claims.

What is claimed is:

1. A connector assembly comprising:

a first component having a slot and an indentation; and a second component comprising:

a hook configured to engage with the slot by being inserted into the slot in a first direction perpendicular to a surface of the first component, and being translated with respect to the slot in a first direction parallel to the surface of the first component;

wherein the hook is configured to resist movement of the second component with respect to the first component in a second direction perpendicular to the surface of the first component when the hook is engaged with the slot; and a protrusion configured to at least partially depress with respect to a surface of the second component as the hook is inserted into the slot in the first direction perpendicular to the surface of the first component and engage with the indentation when the hook is positioned to engage with the slot;

wherein the protrusion is configured to resist movement of the second component with respect to the first component in a second direction parallel to the surface of the first component when the protrusion is engaged with the indentation.

2. The connector assembly of claim 1, wherein the protrusion is configured to resist depression.

3. The connector assembly of claim 2, wherein the protrusion is configured to recover to an initial undepressed position with respect to the surface of the second component when the protrusion engages with the indentation.

4. The connector assembly of claim 2, wherein a side of the protrusion is attached to the second component via a cantilever tab.

5. The connector assembly of claim 2, wherein a force required to disengage the protrusion from the indentation is at least partially determined by a resistance of the protrusion to depression.

6. The connector assembly of claim 1, wherein a force required to disengage the protrusion from the indentation is at least partially determined by a sidewall angle of a sidewall of the protrusion or a sidewall angle of a sidewall of the indentation.

7. The connector assembly of claim 1, wherein a sidewall of the indentation is approximately perpendicular with respect to the surface of the first component to resist disengagement of the protrusion from the indentation when the protrusion is engaged with the indentation.

8. The connector assembly of claim 1, wherein a sidewall of the protrusion is approximately perpendicular with respect to the surface of the second component to resist disengagement of the protrusion from the indentation when the protrusion is engaged with the indentation.

9. The connector assembly of claim 1, wherein the second component includes a locking mechanism and wherein the locking mechanism is configured to resist depression of the protrusion with respect to the surface of the second component when the locking mechanism is engaged in a locking position with respect to the protrusion.

10. The connector assembly of claim 1, wherein the hook has a stem portion extending from the surface of the second component and a head portion extending from the stem portion and wherein the head portion has an overhanging portion that overhangs from the stem portion.

11. The connector assembly of claim 10, wherein the hook is configured to engage with the slot by having the head portion of the hook inserted past through a lip of the slot in the first direction perpendicular to the surface of the first component and having the hook translated with respect to the slot in the first direction parallel to the surface of the first component to position a portion of the lip between the overhanging portion and the surface of the second component.

12. The connector assembly of claim 1, wherein the first direction parallel to the surface of the first component is opposite to the second direction parallel to the surface of the first component.

13. The connector assembly of claim 1, wherein the hook and the slot are configured to resist movement of the second component with respect to the first component in the first direction parallel to the surface of the first component when the hook is engaged with the slot.

14. The connector assembly of claim 1, wherein the hook and the slot are configured to resist rotation of the second component with respect to the first component in a direction parallel to the surface of the first component when the hook is engaged with the slot.

15. The connector assembly of claim 1, wherein the first component is a modular robot.

16. The connector assembly of claim 1, wherein the first component includes a second slot and the second component includes a second hook, wherein the second hook is configured to engage with the second slot by being inserted into the second slot and being translated with respect to the second slot in the first direction parallel to the surface of the first component, wherein the second hook is configured to resist movement of the second component with respect to the first component in the second direction perpendicular to the surface of the first component when the second hook is engaged with the second slot, and wherein the protrusion is configured to engage with the indentation when the second hook is engaged with the second slot.

17. The connector assembly of claim 1, wherein the first component includes a second indentation and the second component includes a second protrusion, wherein the second protrusion is configured to at least partially depress with respect to the surface of the second component as the hook is inserted into the slot in the first direction perpendicular to the surface of the first component and engage with the second indentation when the hook is positioned to engage with the slot, and wherein the second protrusion is configured to resist movement of the second component with respect to the first component in the second direction parallel to the surface of the first component when the second protrusion is engaged with the second indentation.

18. A connector assembly comprising:

a first component having a slot and a protrusion; and a second component comprising:

a hook configured to engage with the slot by being inserted into the slot in a first direction perpendicular to a surface of the first component and being translated with respect to the slot in a first direction parallel to the surface of the first component;

wherein the hook is configured to resist movement of the second component with respect to the first component in a second direction perpendicular to the surface of the first component when the hook is engaged with the slot; and an indentation;

wherein the protrusion is configured to at least partially depress with respect to the surface of the first component as the hook is inserted into the slot in the first direction perpendicular to the surface of the first component and engage with the indentation when the hook is positioned to engage with the slot; and wherein the protrusion is configured to resist movement of the second component with respect to the first component in a second direction parallel to the surface of the first component when the protrusion is engaged with the indentation.

19. The connector assembly of claim 18, wherein the protrusion is configured to resist depression.

20. The connector assembly of claim 19, wherein a force required to disengage the protrusion from the indentation is at least partially determined by a resistance of the protrusion to depression.

21. The connector assembly of claim 18, wherein a force required to disengage the protrusion from the indentation is at least partially determined by a sidewall angle of a sidewall of the protrusion or a sidewall angle of a sidewall of the indentation.

22. The connector assembly of claim 18, wherein a sidewall of the indentation is approximately perpendicular with respect to the surface of the second component and a sidewall of the protrusion is approximately perpendicular with respect to the surface of the first component to resist disengagement of the protrusion from the indentation when the protrusion is engaged with the indentation.

23. A method for connecting a first component and a second component of a connector assembly, the first component having a slot and an indentation, the second component having a hook and a protrusion, the method comprising:

inserting the hook into the slot in a first direction perpendicular to a surface of the first component;

wherein the protrusion is at least partially depressed with respect to a surface of the second component as the hook is inserted into the slot in the first direction perpendicular to the surface of the first component;

translating the hook with respect to the slot in a first direction parallel to the surface of the first component to engage the hook with the slot;

wherein the protrusion engages with the indentation when the hook is positioned to engage with the slot;

wherein the hook resists movement of the second component with respect to the first component in a second direction perpendicular to the surface of the first component when the hook is engaged with the slot; and wherein the protrusion resists movement of the second component with respect to the first component in a second direction parallel to the surface of the first component when the protrusion is engaged with the indentation.

24. The method of claim 23, wherein the protrusion resists depression with respect to the surface of the second component.

25. The method of claim 24, wherein a force required to disengage the protrusion from the indentation is at least partially determined by a resistance of protrusion to depression.

26. The method of claim 23, wherein a force required to disengage the protrusion from the indentation is at least partially determined by a sidewall angle of a sidewall of the protrusion or a sidewall angle of a sidewall of the indentation.

27. The method of claim 23, wherein the first component is a modular robot and wherein the second component is a connector plate, a connector block, or a modular robot accessory.

28. The method of claim 27, wherein the second component restricts the motion of the first component when the first component and the second component are connected.

29. A method for connecting a first component and a second component of a connector assembly, the first component having a slot and a protrusion, the second component having a hook and an indentation, the method comprising:

inserting the hook into the slot in a first direction perpendicular to a surface of the first component;

wherein the protrusion is at least partially depressed with respect to the surface of the first component as the hook is inserted into the slot in the first direction perpendicular to the surface of the first component;

translating the hook with respect to the slot in a first direction parallel to the surface of the first component to engage the hook with the slot;

wherein the protrusion engages with the indentation when the hook is positioned to engage with the slot;

wherein the hook resists movement of the second component with respect to the first component in a second direction perpendicular to the surface of the first component when the hook is engaged with the slot; and wherein the protrusion resists movement of the second component with respect to the first component in a second direction parallel to the surface of the first component when the protrusion is engaged with the indentation.

30. The method of claim 29, wherein the protrusion resists depression with respect to the surface of the first component.

31. The method of claim 30, wherein a force required to disengage the protrusion from the indentation is at least partially determined by a resistance of the protrusion to depression.

32. The method of claim 29, wherein a force required to disengage the protrusion from the indentation is at least partially determined by a sidewall angle of a sidewall of the protrusion or a sidewall angle of a sidewall of the indentation.

33. The method of claim 29, wherein the first component is a modular robot and wherein the second component is a connector plate, a connector block, or a modular robot accessory.

34. The method of claim 33, wherein the second component restricts the motion of the first component when the first component and the second component are connected.

* * * * *